US010309619B2

(12) United States Patent
Joseph et al.

(10) Patent No.: US 10,309,619 B2
(45) Date of Patent: Jun. 4, 2019

(54) SPECIAL EFFECTS SYSTEM FOR GENERATING A MIDAIR LASER BLAST ILLUSION

(71) Applicant: DISNEY ENTERPRISES, INC., Burbank, CA (US)

(72) Inventors: Daniel M. Joseph, Los Angeles, CA (US); Guillermo Fok De Jesus, Los Angeles, CA (US); Justin C. Petronglo, Burbank, CA (US); Samantha L. Kaplan, Los Angeles, CA (US)

(73) Assignee: DISNEY ENTERPRISES, INC., Burbank, CA (US)

( * ) Notice: Subject to any disclaimer, the term of this patent is extended or adjusted under 35 U.S.C. 154(b) by 353 days.

(21) Appl. No.: 15/391,130

(22) Filed: Dec. 27, 2016

(65) Prior Publication Data

US 2018/0180258 A1 Jun. 28, 2018

(51) Int. Cl.

| | |
|---|---|
| ***F21V 14/08*** | (2006.01) |
| ***F21V 11/18*** | (2006.01) |
| ***F21S 10/00*** | (2006.01) |
| *F21Y 115/10* | (2016.01) |
| *F21W 131/406* | (2006.01) |
| *F21Y 115/30* | (2016.01) |

(52) U.S. Cl.

CPC ..... *F21V 14/08* (2013.01); *F21S 10/00* (2013.01); *F21V 11/18* (2013.01); *F21W 2131/406* (2013.01); *F21Y 2115/10* (2016.08); *F21Y 2115/30* (2016.08)

(58) Field of Classification Search

CPC ..... F21V 4/08; G09F 19/12

See application file for complete search history.

(56) References Cited

U.S. PATENT DOCUMENTS 5,418,632 A * 5/1995 Anderson ..... G02B 5/32 348/E13.056

5,678,910 A 10/1997 Martin 6,302,542 B1 10/2001 Tsao (Continued)

OTHER PUBLICATIONS

"Propeller Clock," Mechanically Scanned LED Clock; http://www.bobblick.com/techref/projects/propclock/propclock.html; Copyright 1995-2002 Bob blick; retrieved Oct. 19, 2006.

*Primary Examiner* — Zheng Song

(74) *Attorney, Agent, or Firm* — Marsh Fischmann & Breyfogle LLP; Kent A. Lembke

(57) ABSTRACT

A special effects apparatus for generating an illusion of a moving beam of light in midair. The apparatus includes a light source, such as a laser light source outputting colored light, generating a beam of light that is aimed along a linear light travel path. The apparatus further includes a dynamic light receiving assembly, and this assembly includes: an elongated support rod; a light receiving element attached to a first end of the support rod; and a driver coupled to a second end of the support rod opposite the first end of the support rod. The driver rotates the support rod about the second end at a high rotation rate, and the light receiving element moves along an arcuate travel path that intersects the linear light travel path of the beam of light. The arcuate travel path of the light receiving element and the linear light travel path are coplanar.

24 Claims, 11 Drawing Sheets

(56) References Cited

U.S. PATENT DOCUMENTS

| | | | | |
|---|---|---|---|---|
| 6,554,430 | B2 * | 4/2003 | Dorval | G02B 27/2285 348/E13.022 |
| 6,665,048 | B2 | 12/2003 | Gelbart | |
| 7,740,359 | B2 | 6/2010 | Schnuckle et al. | |
| 8,876,295 | B2 * | 11/2014 | Scanlon | G03B 21/562 345/204 |
| 2009/0046258 | A1 * | 2/2009 | Schnuckle | G03B 21/14 353/94 |
| 2013/0286355 | A1 * | 10/2013 | Lin | G03B 21/206 353/7 |
| 2014/0043589 | A1 * | 2/2014 | Chifu | G03B 21/204 353/33 |
| 2017/0241610 | A1 * | 8/2017 | Yen | F21S 41/125 |
| 2017/0332442 | A1 * | 11/2017 | Strecker | A41D 13/0051 |

* cited by examiner

SPECIAL EFFECTS SYSTEM FOR GENERATING A MIDAIR LASER BLAST ILLUSION

BACKGROUND

1. Field of the Description

The present description relates, in general, to theatrical and other visual special effect devices used to provide lighting-based illusions or displays and, more particularly, to a special effects system (or light-based display system) adapted to provide linear streaks, bolts, or elongated balls light, e.g., an illusion that a theatrical prop such as a futuristic laser-based weapon has fired a laser blast or the like, and the output of the special effects system is 360-degree viewable.

2. Relevant Background

In the entertainment industry, there are many settings or venues where it is desirable to recreate scenes from popular movies often with live actors performing a scene from a movie. An often used lighting effect in movies is a streak or flash of light from various sources. For example, many futuristic movies include battles where the actors operate laser-based props, e.g., blaster gun props, which produce laser blasts. The laser blast beams in the movie travel through the air and may have the appearance of a volumetric ball or slug of light, which may be red, green, blue, or another color, that travels from the actor's weapon prop through the air in a line to its target.

To create such a scene in a movie, post-production computer graphics and other techniques are used to easily achieve the laser-blast effect inserting streaks of light after filming is completed. However, it has been problematic to create a similar effect in theatrical settings in real time or during a live production. This is especially troublesome because it is often desirable for the effect to be viewable in 360 degrees or from a wide range of viewing angles, such as both sides of a stage or set where actors are performing a movie-based scene. Further, the reproduced scene should look like the scene in the film.

Existing special effects and display systems have not been wholly successful at providing desired lighting-based illusions involving streaks, flashes, or balls of volumetric light appearing in air. One conventional technique is project imagery onto a flat screen or wall positioned between the actor and their weapon prop and the target. Another special effects technique is to provide a Pepper's Ghost assembly on the set or in the display space. Neither of these solutions provides 360-degree viewing of the special effect, e.g., the use of a stationary projection screen or wall can only be viewed from one side. Also, projection on a wall appears flat and does not provide the desired volume to the "ball" or "slug" of light being fired from the prop weapon (or providing a similar effect). Pepper's Ghost assemblies are limited to use in corridors and enclosed spaces with a very limited viewing angle.

As will be understood, neither of these special effects approaches is useful for creating the desired streak of light that can be viewable from all directions, appears to be volumetric, and creates the illusion in midair. There remains a need for a new special effects system that overcomes the problems with prior devices and is useful in a wide variety of settings.

SUMMARY

Briefly, a special effects system (or theatrical prop lighting assembly) is provided that is operable to generate a lighting effect that appears as a bolt or streak of light, such as a green cylinder of light that is several-to-many inches long (e.g., 6 inches to 18 inches in length or more length when two or more dynamic light receiving assemblies are used to provide "hand offs" of the bolt or streak of light) with no visually perceivable projection screen or surface. In this way, a volumetric slug or ball of light moves in midair through viewer's field of vision for unique displays useful for recreating movie-like laser blasts that are 360-degree viewable, e.g., from the front or back as the light may pass between two sets of viewers.

The special effects system can be placed into nearly any show set space and be viewed from any direction. However, viewers typically will be blocked from certain viewpoints, such as looking directly at the outlet of the light source or being near the path of components providing the light bolt for safety reasons and to better conceal the effect. The special effects system can be implemented at a relatively low cost due to the design and nature of the mechanics and components used to create the laser blast or midair light streak (or bolt) effect. The special effects system is also useful in conditions or theatrical spaces/sets with higher ambient lighting levels in which prior devices are typically ineffective.

More particularly, a special effects apparatus or system is provided for generating an illusion of a moving beam of light in midair. The apparatus includes a light source generating a beam of light that is aimed along a linear light travel path, and the light source may take the form of a laser light source providing a colored laser beam or a collimated light emitting diode (LED) source providing red, green, or blue beams. The apparatus further includes a dynamic light receiving assembly, and this assembly includes: an elongated support rod (e.g., a pultruded carbon fiber or fiberglass rod that is 3 to 6 feet long); a light receiving element attached to a first end of the support rod; and a driver (or actuator) coupled to a second end of the support rod opposite the first end of the support rod.

To achieve the illusion of a midair laser blast or the like, the driver rotates the support rod about the second end at a high rotation rate (e.g., greater than about 100 RPM). During the rotation of the support rod by the driver, the light receiving element moves along an arcuate travel path that intersects the linear light travel path of the beam of light. Further, the arcuate travel path of the light receiving element and the linear light travel path are substantially coplanar (or the light receiving element is causes to travel in the plane of the light).

In some embodiments, the light receiving element includes a planar frame (e.g., a wire shaped into a rectangle affixed to the first end of the support rod) and a sheet of mesh fabric supported by the planar frame. The planar frame and arcuate travel path are coplanar, and the sheet of mesh fabric is not orthogonal to the light as in typical projection-based effects but is instead struck by the light along its thin edge/end. A mesh fabric is used to provide a receiving surface that is not opaque but is able to receive (and reflect) light, and, in some cases, the mesh fabric is a black tulle fabric. The sheet of mesh fabric may be rectangular in shape with a width, as measured along a side proximate to the first end of the support rod, that is less than a height of the rectangular shape. In some particular implementations, the height may be in the range of 7 to 9 inches and the width is in the range of 5 to 7 inches (e.g., 8 inches by 6 inches). To provide a longer streak or bolt of light in midair (such as a streak in the range of 30 to 49 inches but typically in the range of 41 to 49 inches), when the support rod is fully deployed, the apparatus is designed such that the linear light travel path intersects the rectangular sheet of mesh fabric at a centerline or between the centerline and the side proximate to the first end of the support rod (e.g., at a distance below the centerline).

The rotation rate is in the range of 115 to 125 revolutions per minute (RPM) to disguise the presence of the light receiving element in the display space observed by a viewer (e.g., the viewer only sees the displayed streak or bolt of light and not the screen/flag of mesh fabric or the support rod). Further, to achieve a desired illusion, the support rod has a length in the range of 3 to 6 feet and has a black outer surface. In the same or other embodiments, the arcuate travel path may be a 180-degree arc or semi-circle, and the driver (e.g., a motor and a drive shaft with the support rod affixed near the second end to the drive shaft) includes a catcher assembly adapted to catch the support rod proximate to the second end and to absorb shock at opposite ends of the arcuate travel path (and to slow or reduce the rate of deceleration) to limit vibration or resonance of the support rod.

DETAILED DESCRIPTION OF THE PREFERRED EMBODIMENTS

Figure 1A:
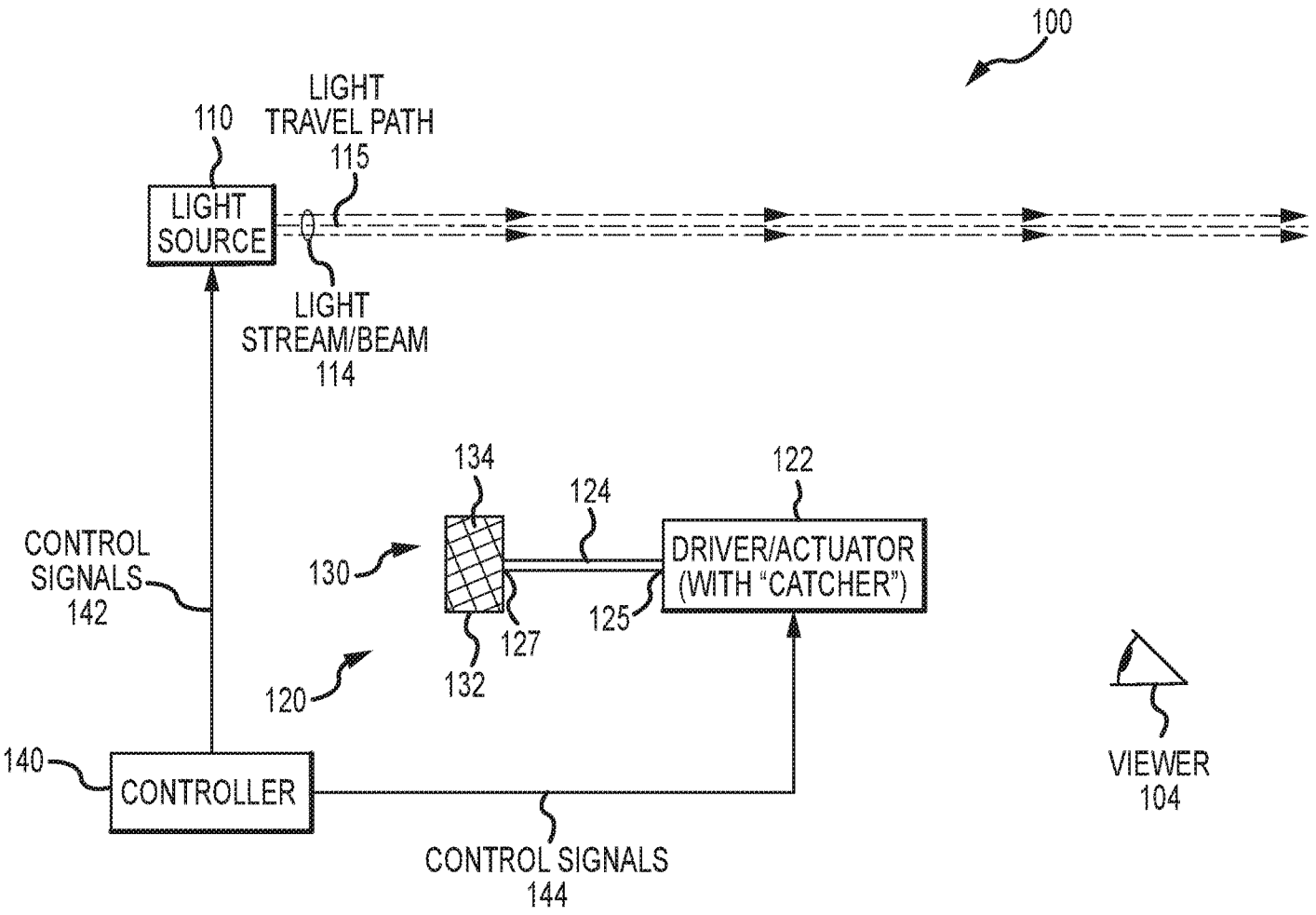
FIGS. 1A and 1B are functional block diagrams of a special effects system showing its operations at a first time and operating state with the light receiving screen retracted and at a second time and operating state with the light receiving screen being deployed (e.g., moved through an arcuate or semi-circular travel path) to display a volumetric bolt or streak of light in midair.

Briefly, a special effects system is described herein that is useful for producing bolts or linear streaks of light that appear to have volume and are 360-degree viewable, even in relatively high ambient light settings, in midair. The special effects system includes a light source (such as a laser beam source, a source providing bright collimated light, or other light source) that is static and targeted or aimed to provide a stream or beam of light along a path in a predefined plane. The special effects system further includes one or more dynamic light receiving assemblies, which are each configured to very rapidly (e.g., at a speed high enough to avoid detection by the viewer) move a light receiving flag or element through an arcuate path. The arcuate path is co-planar with the plane including the light stream/beam path such that the light receiving flag or element, which typically includes a planar screen, is moved through the light stream or beam such that an elongate bolt or linear streak of light is displayed on the rapidly moving screen.

In one exemplary embodiment, the dynamic light receiving assembly includes a carbon fiber rod with a small light receiving flag on one end. A driver or actuator (e.g., a 180-degree actuator or a 360-degree driver) is coupled to the other end of the rod. The driver or actuator is operated by a controller to move the rod (or flag support member) through the air at very high speeds (e.g., a rotation rate of 75 to 150 revolutions per minute (RPM) or the like with a rotation rate of about 120 RPM being used in one prototype), and the driver or actuator may include a "catcher" or brake assembly to slow the rod down very quickly (in 180-degree rotation embodiments) prior to rotating back in the other direction (e.g., the light-based special effect can be created with the light receiving flag moving in either direction (e.g., clockwise or counterclockwise or toward or away from the light source). With the combination of the light source and the dynamic light receiving assembly (or assemblies), the laser blast or similar light effect can be generated in a repeatable and controlled (or timed/synchronized) manner.

In some embodiments, the dynamic light receiving assembly has the appearance of a device used to rapidly rotate (through a 180-degree, 360-degree, or other arcuate path) a large fly swatter. The "fly swatter" is provided by the flag support member or rod with a light receiving flag at one end that may be a frame (e.g., a wire rectangular frame) that holds or houses a screen. The screen is chosen to opaque enough to light to be able to receive the light from the light source but not so opaque that it is readily perceived by the viewer. Generally, the screen may be formed as a scrim from a mesh material, which, in some embodiments, takes the form of black tulle fabric (e.g., nylon tulle or the like).

The light source was chosen to provide bright collimated light or a fat beam laser that moves along a predefined linear path in a particular display plane. The arcuate path of the support rod is in a plane that is co-planar with this display plane and is chosen such that the light receiving screen (e.g., a planar rectangular swatch of black tulle fabric) is moved through the light stream/beam, which causes a linear portion of the light receiving screen to be illuminated. Through the workings of human vision (e.g., the human eye and persistence of vision), the viewer sees a traveling bolt or streak of light move through midair but no support rod and no light receiving screen. In brief, the viewer sees (or, more accurately, consciously perceives) nothing except the bolt or streak of light.

Figure 1B:
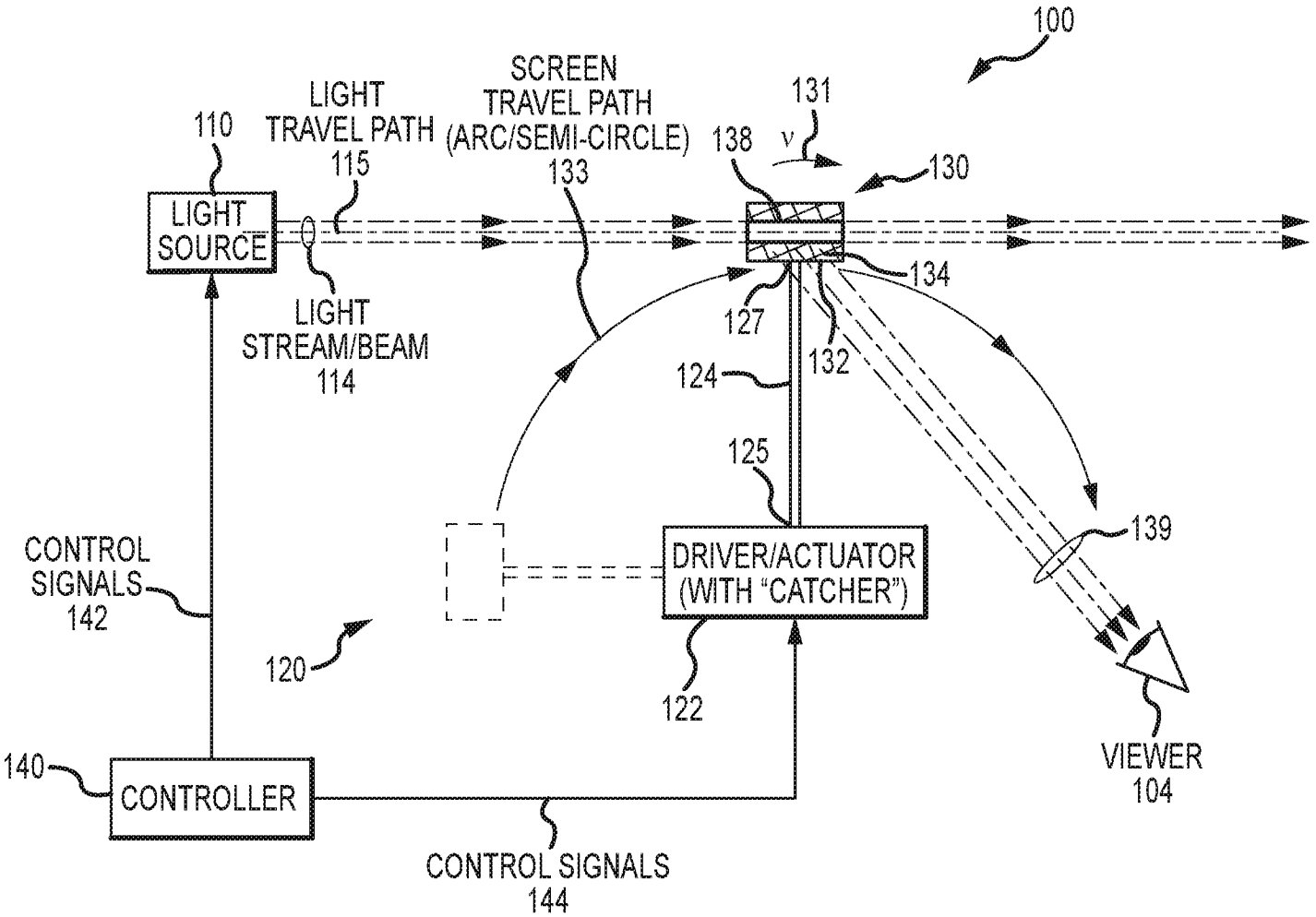

FIGS. 1A and 1B are functional block diagrams of a special effects system 100 showing its operations at a first time and operating state (screen retracted or pre-deployment) and at a second time and operating state (screen deployed) to display a volumetric bolt or streak of light in midair to a viewer 104. As shown, the system 100 includes a light source 110 that operates in response to control signals 142 from a controller 140 (e.g., a computer with a processor running software/programs to provide the control functions described herein). Particularly, the light source 110 is shown to output or generate a light stream or beam 114 along a linear light path 115 in the display space observable by a viewer 104. In the operating state shown in FIG. 1A, there are no surfaces provided in the display space such that viewer 104 does not see or perceive the light stream/beam 114.

The light source 110 may take many forms to practice the special effects system 100. It is generally desirable that light 114 be relatively bright and be provided in a volumetric or "fat" stream or beam that can be aimed or targeted along a predefined travel path 115. In some cases, the beam 114 is white while in other cases the source 110 is chosen to provide colored light (e.g., red, blue, green, or other colored light). Some embodiments use a light source 110 that outputs collimated light to provide the light stream/beam 114. For example, the light source 110 may use a laser light source such as a laser light source projector (e.g., with a laser light engine to provide RGB color). In other cases, collimated light for the light stream/beam 114 is provided with a light source 110 in the form of a collimated light emitting diode (LED) source (e.g., an LED emitting red, green, or blue light or a combination of the three to create light 114 as a stream of any desired color). In still other cases, theatrical lighting is used for the source with its output focused into a relatively tight cylindrical beam to provide the stream/beam 114 along a travel path 115. The light source 110 may be on continuously or may be only turned on by the controller 140 when the driver/actuator 122 is operated by the controller 140 to move the light receiving element 130 into the path of the output stream 114 from light source 110 so as to limit opportunities of viewers to detect the presence of the source 110.

The special effects system 100 further includes a dynamic light receiving assembly 120. This assembly 120 includes a driver or actuator 122 coupled to the first or lower end 125 of a support rod (or elongated screen support) 124, and the driver or actuator 122 is selectively operable via control signals 144 from the controller 140. In FIG. 1A, the driver/actuator 122 is inactive or in a standby mode in which the support rod 124 is at a lowered position (e.g., at 0 degrees (or 180 degrees) when the travel path is a 180-degree arc or half circle).

The driver/actuator 122 may take a wide variety of forms to practice the system 100, and it is generally selected to be capable of rotating the rod 124 through an arcuate or semi-circular (to circular) path at a rapid rate (such as in the range of 100 to 140 (or more) RPM or the like with 115 to 125 RPM being useful in some embodiments) to avoid or limit perception by the viewer 104 during deployment/movement of the rod 124. For example, the driver/actuator 122 may be a pneumatic actuator with an inlet to cause movement in a first direction (e.g. clockwise) and then later in a second direction (e.g., counterclockwise) while other embodiments may use an electric motor/actuator. One prototyped embodiment used a pneumatic rotary actuator running at about 40 psi to rotate the whip assembly. A catcher or brake assembly (as explained in more detail below) may be included to assist the rapid stopping of the rod 124 at the ends of its travel path (unless a 360-degree path is used) and to limit vibration (which may be undesirable noisy or cause damage to the components of the assembly 120).

The support rod 124 may also take a variety of forms to implement the system 100. In some embodiments, the rod 124 is 3 to 6 feet or more in length, and it provided as a cylindrical rod which may have a single diameter (same at each end 125 and 127) or may be tapered similar to a fishing rod with a greater diameter at the inner end 125 than at the outer end 127. In some cases, the rod has an outer diameter in the range of 0.15 to 0.5 inches (with one prototype using a 0.246-inch OD rod as measured at the base end 125). The rod 124 in one useful embodiment was formed from a carbon fiber rod (e.g., a pultruded rod) while other embodiments utilized a fiberglass reinforced plastic rod (again, which may be formed using pultrusion or other techniques). To limit detection by the viewer 104, the rod 124 is moved very rapidly through the display space but it can also be designed with features that limit its perception such as a smaller diameter and choosing a color (e.g., a darker color such as black) and outer finish (matte or the like) that limits reflection of ambient light to the viewer 104.

At the outer end 127, the rod 124 supports a light receiving screen or element 130. This element 130 is generally formed of an outer frame 132 (e.g., a black or other dark colored plastic or metal wire frame or the like) and a screen 134 supported by the frame 132 to be taut and planar. The screen 134 is fabricated from a material that is opaque enough to receive (and typically reflect) the light 114 from source 110 but not wholly opaque such that is easily seen or perceived by the viewer 104. In general, the material for the screen 134 is mesh and a relatively dark color. In some embodiments, the screen 134 is formed of a black tulle fabric.

The shape and size of the screen 134 may be varied to practice the system 100. For example, the screen 134 may be rectangular as shown or may be circular, square, triangular, hexagonal, or a combination shape (e.g., a rectangle with a triangular outer end). The inventors, however, performed numerous experiments and discovered that a rectangular shape works very well for the screen 134 with its base (side attached to supporting end 127) being smaller than the height of the sides. It was also discovered that a larger screen 134 did not necessarily increase the size (e.g., length) of the achieved/displayed light bolt/streak with rectangles with bases in the range of 3 to 9 inches and sides in the range of 4 to 12 inches being useful (and with one optimized prototype using a screen that was 6 inches by 8 inches).

FIG. 1B illustrates the special effects system 100 at a second time during a second operating state in which the control signals 144 from the controller 140 cause the driver/actuator 122 to deploy the light receiving element 130 into the display space. Specifically, the driver/actuator 122 acts to rotate the support rod 124 through a 180-degree arc or to rotate its base 180 degrees. This causes the light receiving element 130 and its screen 134 to travel along the arcuate or semi-circular screen travel path 133 shown in FIG. 1B, with the light receiving element 130 shown at the mid-way point in the path 133 (or with the rod 124 rotated to 90 degrees relative to the retracted position shown in FIG. 1A).

The rotation shown with arrow 131 is a rapid rate/speed, V, such as in the range of 100 to 140 (or more) RPM, with some embodiments using a rotation rate of 115 to 125 (or about 120) RPM to avoid or limit perception or detection of the screen 134 and rod 124 by the viewer 104. FIG. 1B shows operation of the assembly 120 at a particular moment in time while it will be understood that the high rotation rate, V, the screen 134 is only at the shown position for very small amount of time during each rotation (during each travel of the screen 134 along the path 133). However, the arcuate path 133 is in a plane that is chosen or set to coincide with or be coplanar with a plane containing the linear light travel path 115 (i.e., the linear path 115 is within the same plane containing the arcuate path 133 of the screen 134).

As a result, the light beam/stream 114 output from the light source 110 illuminates a portion 138 of the mesh screen 134, which causes light to be reflected or delivered as shown at 139 to the viewer 104. Note, the light 114 is striking the thin portion or end of the planar screen 134 (i.e., the light 114 is "in-plane" with the flag/screen 134 and not orthogonal as is typical when projecting onto a surface). The viewer 104, due to persistence of light, perceives this volumetric cylinder or rectangle (bolt/streak) of light 138, along with illuminated portions of the screen 134 illuminated with the screen 134 at positions along the path 133 nearby (on either side) to the position shown in FIG. 1B (e.g., the screen 134 is positioned in the path 115 of the light 114 over a range of angles of rotation near 90 degrees (such as 80 to 100 degrees). The length of the bolt/streak of light 138 typically is some amount greater than the width of the base of the screen 134 (such as 1.5 to 8 times (or more) the size of the base as prototypes with a screen 134 with a base of 6 inches have been estimated to provide a bolt/streak of light 138 that is 18 to 40 or more inches long). Note, with reference to FIG. 11 and testing, a screen with a base of 6 inches (and a height of 8 inches) is estimated to produce a beam in the range of 41 and 49 inches. As shown, the assembly 120 is positioned relative to the light source 110 and the travel path 115 of the output beam 114 such that the light 114 strikes the middle of the screen 134 to provide the illuminated portion 138 (e.g., the linear travel path 115 bisects the rectangular area of the screen 134), and this tends to provide a larger and/or longer streak or bolt when perceived 139 by the viewer 104.

Figure 2:
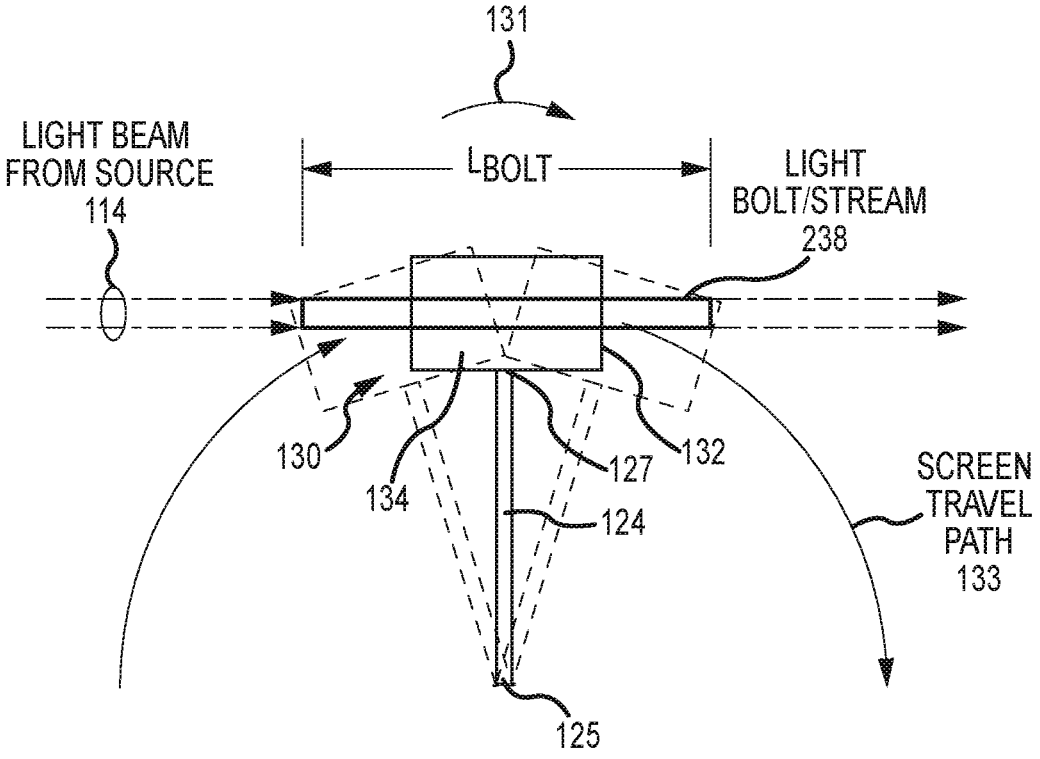
FIG. 2 illustrates the light receiving element in several positions (angular positions) about the fully deployed position (90 degrees rotation of the support rod) in which light from the source strikes the rapidly moving flag/screen.

FIG. 2 illustrates the light receiving element 130 in several positions (angular positions) about the fully deployed position (90 degrees rotation of the support rod 124). As discussed with reference to FIG. 1B, the assembly 120 is oriented such that the flag/screen 134 is passed through an arcuate travel path 133 that is in a plane that also includes the linear travel path 115 of the output light beam 114 from the light source 110. When the screen/flay 134 is fully deployed (or the rod 124 is at 90 degrees rotation from the retracted position in this example), the light path 115 bisects the rectangular area of the screen 134 to provide a first and relatively large portion of the viewable light bolt/streak 238.

However, as shown in FIG. 2, the light 114 also strikes the flag/screen 134 in numerous other positions of the flag/screen 134 on either side of this fully deployed position. The illumination of the screen 134 in these other positions causes the illuminated portions of the screen 134 to be seen by a viewer, and, due to the rapid rotation of the screen 134, all of these portions are perceived as being concurrently illuminated to produce a larger (e.g., longer and larger volume) streak/bolt of light 238. The angular rotation range where light 114 strikes at least a portion of the screen 134 may vary with the positioning of the assembly 120, with the shape of the screen 134, and with the size of the screen 134. However, the rotation range may be a range of about 30 degrees such as 75 to 105 degrees when full deployment is identified as being 90 degrees of rotation.

Figure 3:
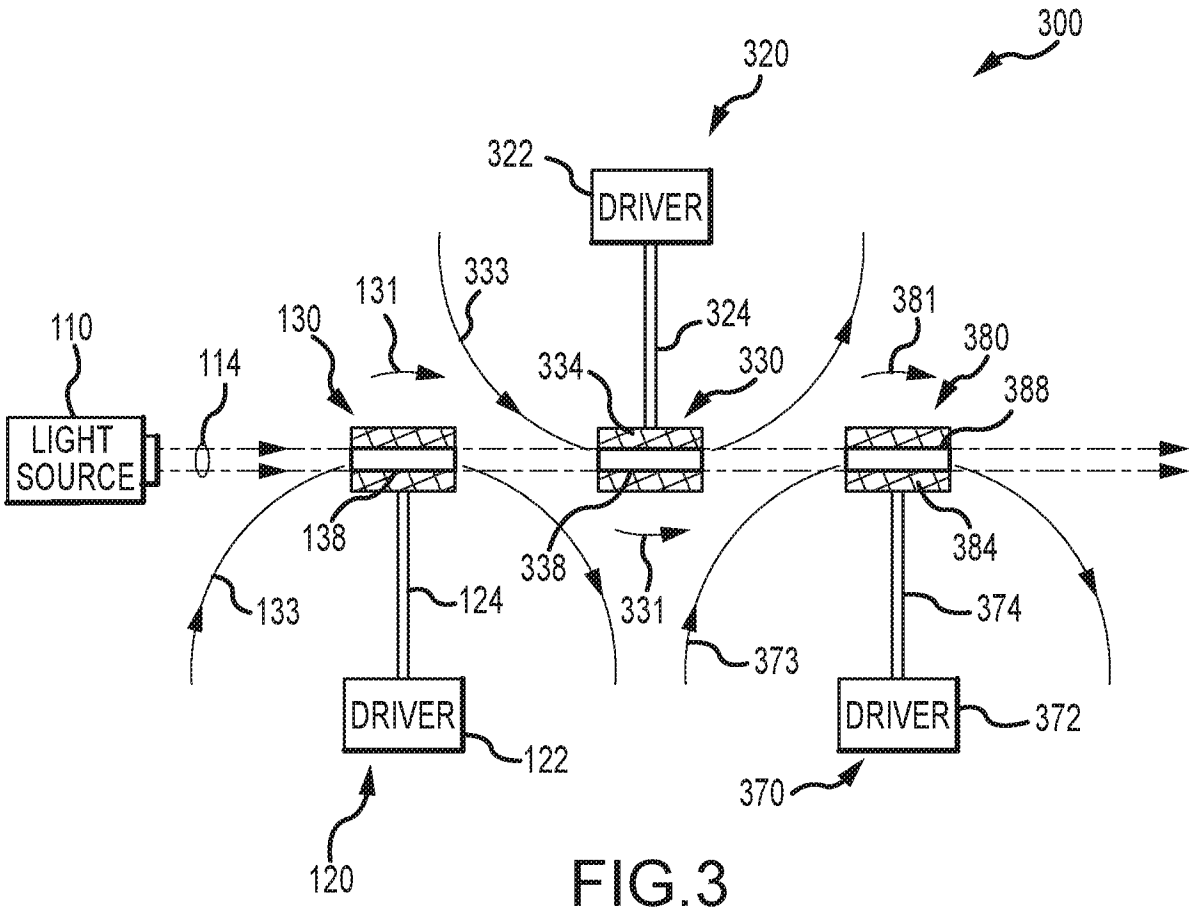
FIG. 3 illustrates a special effects system that is provided through a modification of the system of FIGS. 1A and 1B to include additional dynamic light receiving assemblies so as to increase the length and/or quantity of light bolts/streaks produced with a light source.

In some cases, it may be desirable to provide a longer or larger streak or bolt of light in a space, and this may be achieved by combining two or more of the dynamic light receiving assemblies to place two or more of the light receiving elements (e.g., the flags/screens) into the light path of the light source. FIG. 3 illustrates a special effects system 300 that may be provided through a modification of the system 100 of FIGS. 1A and 1B to include additional dynamic light receiving assemblies 320 and 370 so as to increase the length and/or quantity of light bolts/streaks produced with a light source 110 with its output beam/stream 114 (of collimated light).

As shown, a second dynamic light receiving assembly 320 is provided in the system 300 to be "downstream" of the first assembly 120 relative to the light path 115 of the beam/stream of light 115 from the light source 110. The first assembly 120 may be floor (or wall) mounted and the second assembly 320 may then be ceiling (or opposite wall) mounted. The second assembly 320 includes similar components as assembly 120 including a driver 322 for rotating 331 a support rod 324 upon which a light receiving element 330 is mounted. The second assembly 320 rotates the screen 334 through an arcuate travel path 333 that is in the same plane as the path 133 (and the two screens 134 and 334 are also coplanar to the plane containing these paths 133, 333 and are coplanar to each other). The path 333 is spaced apart from first screen travel path 133 such that the screen 334 is illuminated along a later stretch or length of the light travel path 115 by the beam/stream of light 114. This creates a second bolt/streak of light 338 visible by a viewer along the light travel path 115, which is added to the streak bolt 138 in the perception of a viewer. The two streaks/bolts 138, 338 may be nearly contiguous or may be separated by a small distance (e.g., to avoid collisions between the two rotated flags/screens 134, 334).

Similarly, a third assembly 370 is provided with a driver 372 that is floor (or wall) mounted similar to the driver 122 of assembly 120. The assembly 370 includes a support rod 374 and a light receiving element 380. The driver 372 operates to rotate 381 the screen 384 through an arcuate travel path 373 that passes through the light path 115 such that light 114 illuminates a portion 388 of the screen 384, and this creates or displays an additional streak/bolt of light 388. This bolt/streak 388 is perceived concurrently with the other bolts/streaks 138, 338 due to the concurrent rotation of the three screens 134, 334, and 384 at high rates such that three bolts/streaks 138, 338, 388 may be perceived as a single "blast" from the light source 110 (or a prop weapon built up around or to include the source 110). Hence, the overall length of this bolt/streak is the combined length of the three bolts/streaks 138, 338, 388 (each of which would include illuminated portions of the screens 134, 334, 384 over a range of rotation angles of the rods 124, 324, 374 that place the screens 134, 334, 384 into the path 115 of the light 114 so longer than shown in FIG. 3). Additional (or fewer) assemblies may be used to increase (or reduce) the length of the displayed light bolt/streak provided by the system 300.

Figure 4:
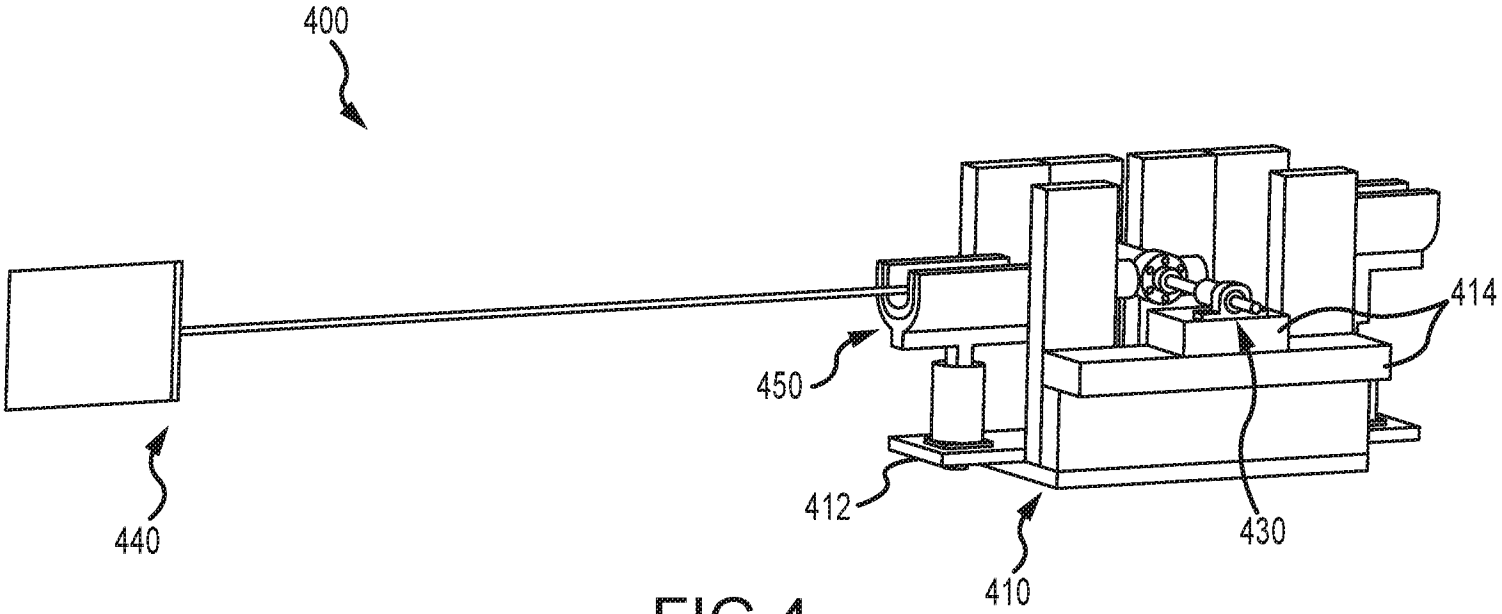
FIGS. 4 and 5 are side and end perspective views, respectively, of a dynamic light receiving assembly of the present description such as may be used in the systems of FIGS. 1A-3.
Figure 5:
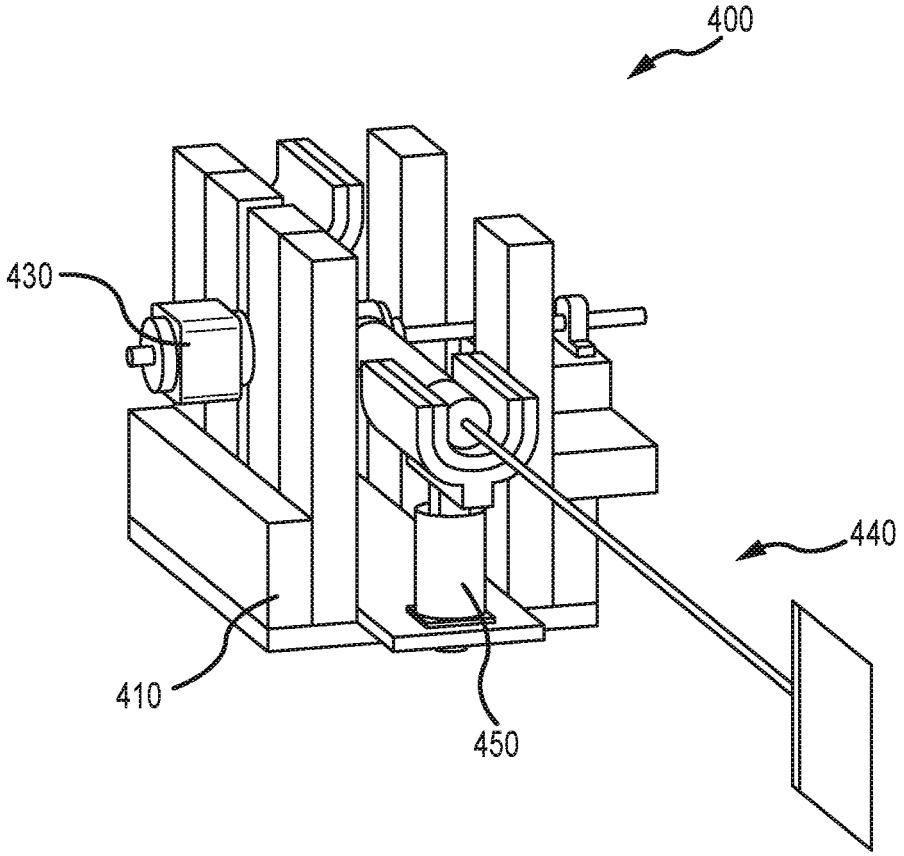

With a general understanding of a special effect system of the present description understood, it may now be useful to describe a particular implementation of an assembly for rapidly deploying (and retracting) a light receiving element (e.g., a mesh screen or flag). FIGS. 4 and 5 are side and end perspective views, respectively, of a dynamic light receiving assembly 400 of the present description such as may be used in the special effects systems of FIGS. 1A-3 discussed above. In FIGS. 4 and 5, the light receiving assembly 400 is shown in a first operating state with the whip assembly 440 retracted or in a retracted state (e.g., with the support rod of the whip assembly 440 at 0 degrees and the support rod resting in a first catcher and with the planar screen/flag oriented to being in a plane including the central axis of the support rod and being orthogonal to a plane containing the base member 412 (or as surface to which the base member 412 is affixed)).

As shown, the light receiving assembly 400 includes a base assembly 410, a driver (or actuator) assembly 430, a whip assembly 440, and a brake assembly 450. The base assembly 410 is configured for mounting the light receiving assembly 400 on a floor, on a ceiling, on a wall, within a prop body, or other surface, and the base assembly 410 is configured for physically supporting the components of the light receiving assembly 400 and may take a wide variety of forms to provide these functions. In the illustrated example, the base assembly 410 includes a base member or platform 412 for rigidly coupling with a mounting surface (not shown) and also for supporting the brake assembly 450. The base assembly 410 also includes support members 414 for coupling the driver assembly 430 to the base member or platform 412 (while allowing the shaft of the driver assembly 430 to rotate and providing slots/gaps for the shaft/rod of the whip assembly 440 to rotate through a desired amount of rotation (e.g., 180 degrees) between brake assembly components).

Figure 6:
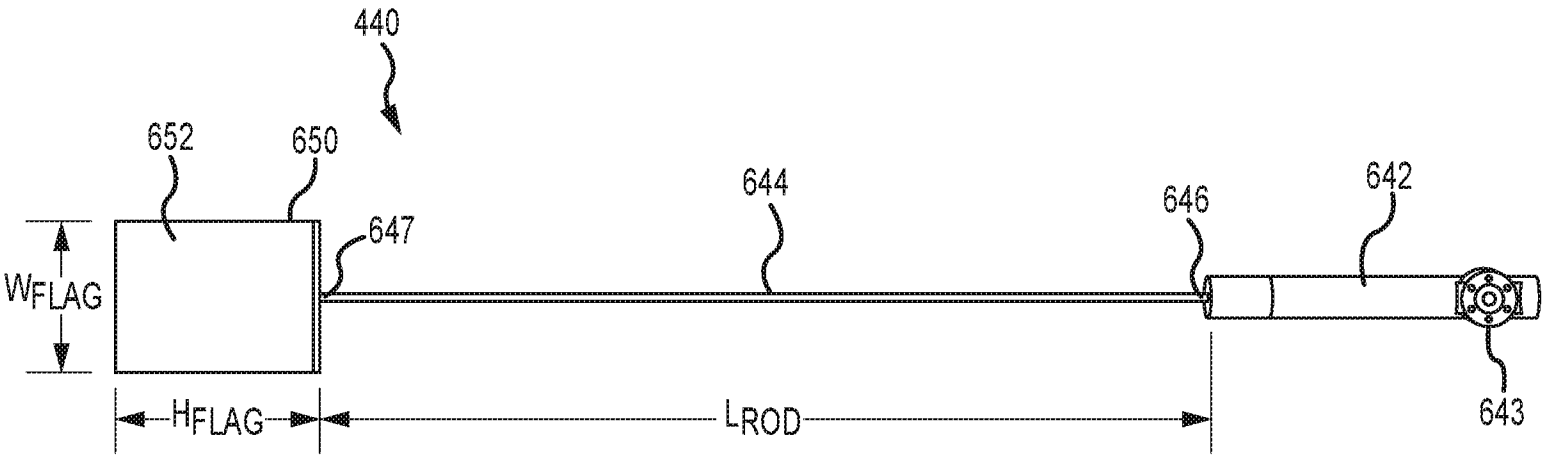
FIG. 6 is a side view of the whip assembly of the light receiving assembly of FIGS. 4 and 5.

FIG. 6 is a side view of the whip assembly 440 of the light receiving assembly of FIGS. 4 and 5. As shown, the whip assembly 440 includes a mounting sleeve 642 with a shaft coupler 643 for rigidly attaching the sleeve 642 to the drive shaft of the driver assembly 430 (i.e., the drive shaft passes through the coupler 643 as can be seen in FIG. 4 and one or more set screws or other fasteners may lock the coupler 643 to the shaft) such that the sleeve 642 rotates with rotation of the drive shaft.

The whip assembly 440 further includes a support rod 644 that is constrained at a first or inner end 646 inside the sleeve 642 to move with the sleeve 642. At the opposite second or outer end 647 of the rod 644 a flag or screen 652 is mounted to a frame 650, which is rigidly attached to the rod 644. The rod 644 may have a length, $L_{Rod}$, of 3 to 6 feet or more, and it may be provided as a tube such as a pultruded carbon fiber tube (hollow) with an OD in the range of 0.15 to 0.3 inches such as 0.22 inches. The rod's length, $L_{Rod}$, defines the length of the arc through which the flag/screen 652 travels.

The flag or screen 652 is contained within a frame 650, which in one embodiment was provided as a length of 0.055-inch diameter spring wire bent into a rectangle (e.g., a 6-inch by 8-inch rectangle) that sits within the end 647 of the rod 644. The flag or screen 652 in one embodiment was provided as a swatch or piece of tulle fabric that spans the wire frame 650. The flag/screen 652 is the part of the assembly 400 that travels in the plane of the light beam/stream (e.g., a laser beam, a collimated light stream/beam from a collimated light source, or the like), and the light striking the rapidly rotating flag/screen 652 creates the illusion of a moving light beam.

Figure 7:
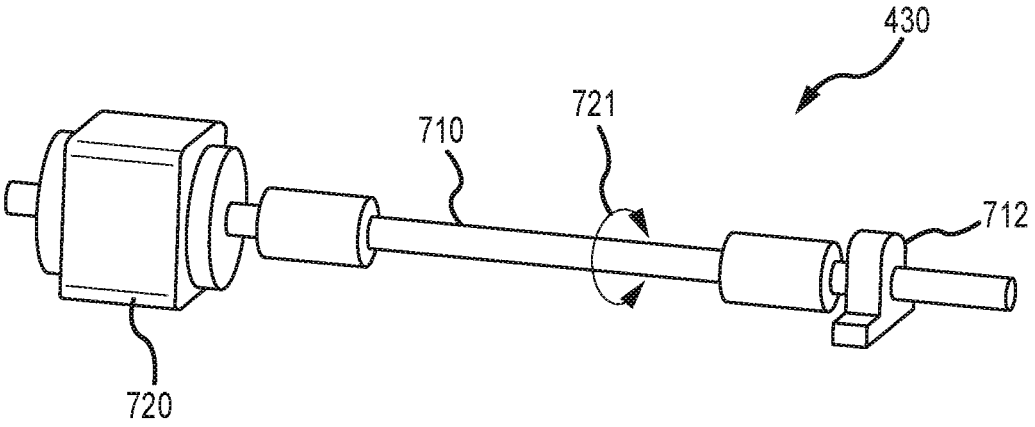
FIG. 7 is a side perspective view of the driver/actuator assembly of the light receiving assembly of FIGS. 4 and 5.

FIG. 7 is a side perspective view of the driver/actuator assembly 430 of the light receiving assembly 400 of FIGS. 4 and 5. As shown, the assembly 430 includes a drive shaft 710 that is rotated, e.g., through 180 degrees, by a drive motor 720. The drive motor 720 is chosen to be able to provide the rotation 721 at a high rate such as 100 to 140 RPM (with one prototype using a rotation rate of approximately 120 RPM). The drive motor 720 is attached to one or more of the base supports 414. A shaft collar/support (or bearing) 712 is included for pivotally supporting (e.g., with bearing surfaces) the end of the shaft 710 opposite the motor 720, and the collar 712 is affixed to one of the base supports 414. As shown in FIGS. 4 and 5, the sleeve of the whip assembly 440 is connected to the shaft 710 to move with the rotation 721 of the shaft 710.

Figure 8:
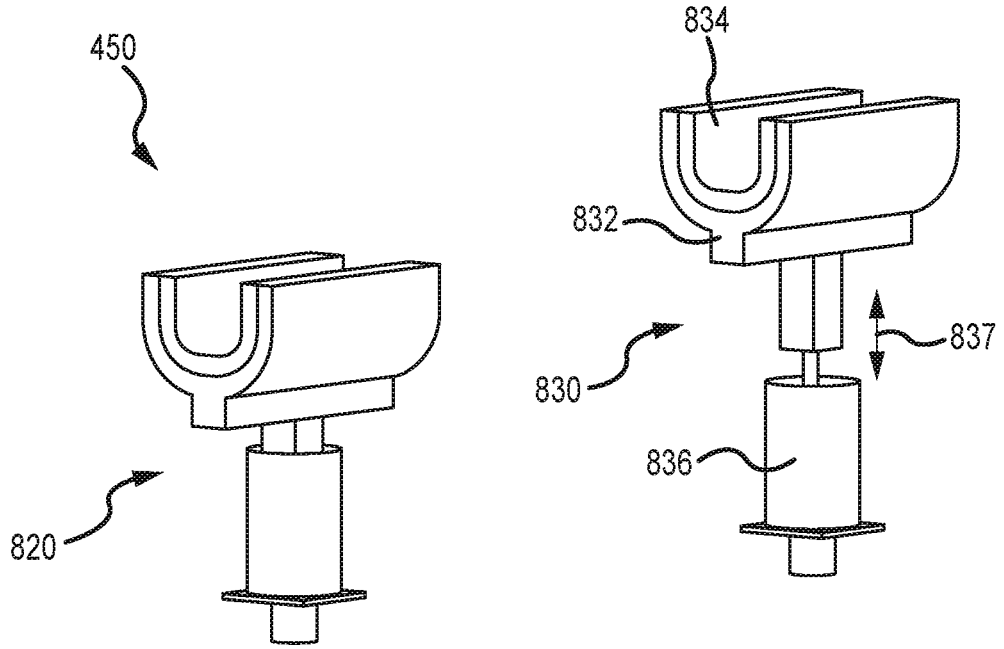
FIG. 8 is a perspective end view of the braking assembly of the light receiving assembly of FIGS. 4 and 5.

FIG. 8 is a perspective end view of the braking assembly 450 of the light receiving assembly 400 of FIGS. 4 and 5. The braking assembly 450 includes left and right (or first and second) brake members or elements 820, 830, with similar configuration such that the description below of member/element 830 is applicable to member/element 820. As shown, the brake element 830 includes a catcher or rod-receiving channel 832 that is mounted onto a shock absorber 836 (e.g., an air snubber). In use, at the end of the rotation of the whip assembly 440, the whip sleeve 642 is caught by the catcher of these two brake members/elements 820, 830 and is slowed to a more gradual stop (e.g., to limit vibration associated with hard stop).

The catcher or rod-receiving element 832 is a part designed, such as a partial cylinder or open-topped tube, to specifically accommodate the whip sleeve 642 (e.g., with an ID greater than the OD of the sleeve 642 by some predefined amount) as it completes its arc of movement. The dimensions, including length, height, and width, of the catcher 832 were chosen or, in some cases, maximized or optimized for this purpose. As shown, a pad 834 is provided upon the inner or contact surfaces of the catcher 832 to soften the impact of the whip sleeve 642 on the catcher 832. In one embodiment, the pad 834 takes the form of a layer of memory foam that coats the inside of the catcher 832. The catcher 832 is coupled with a piston of a shock absorber 836 to allow at least some movement 837 of the catcher 832 upon receipt of a whip sleeve 642. For example, the shock absorber 836 may be an adjustable pneumatic shock absorber that acts to help decelerate the whip assembly 440 at the ends of its travel path/arc. The shock absorber 836 can be adjusted so as to allow minimum resonance of the carbon fiber rod 644 of the whip assembly 440 upon impact with the catcher 830 and its pad 832.

Figure 9:
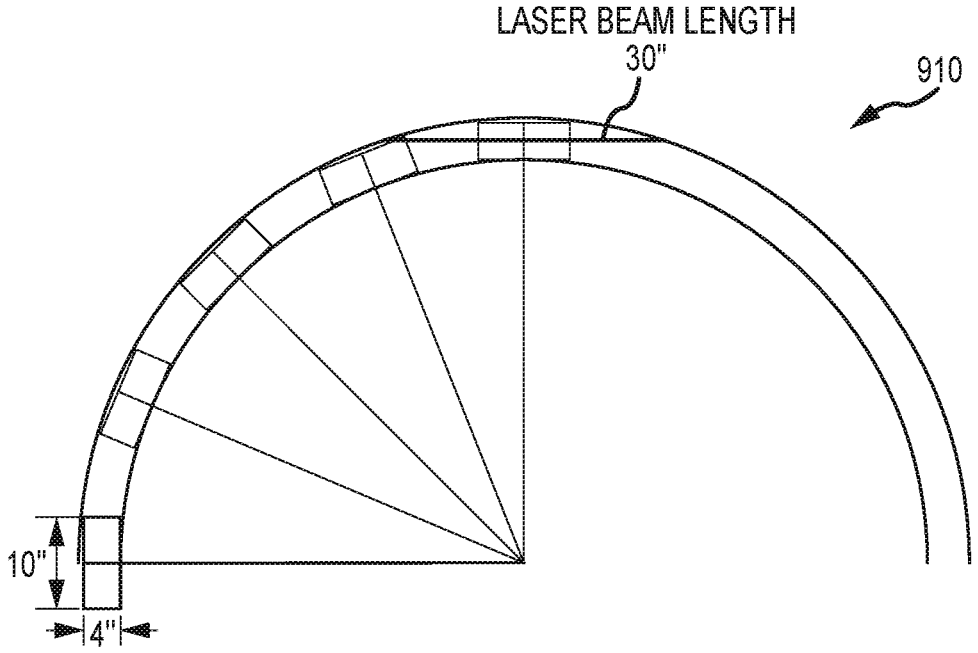
FIGS. 9-11 are graphic illustrations of various tested or modeled flag/screen sizes and/or shapes and resulting light bolts or streak lengths.
Figure 10:
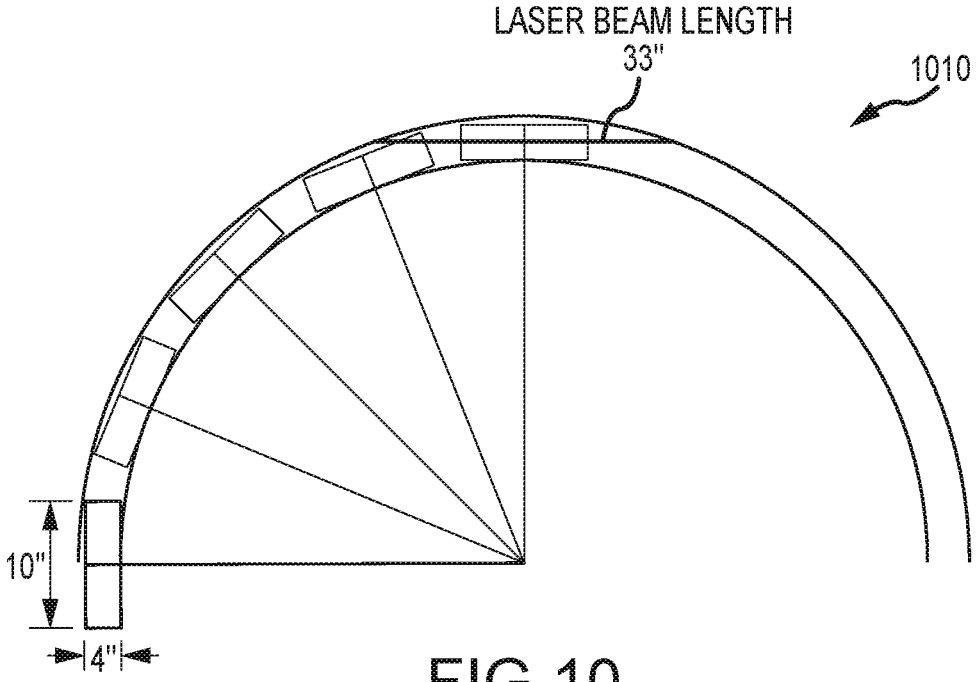
Figure 11:
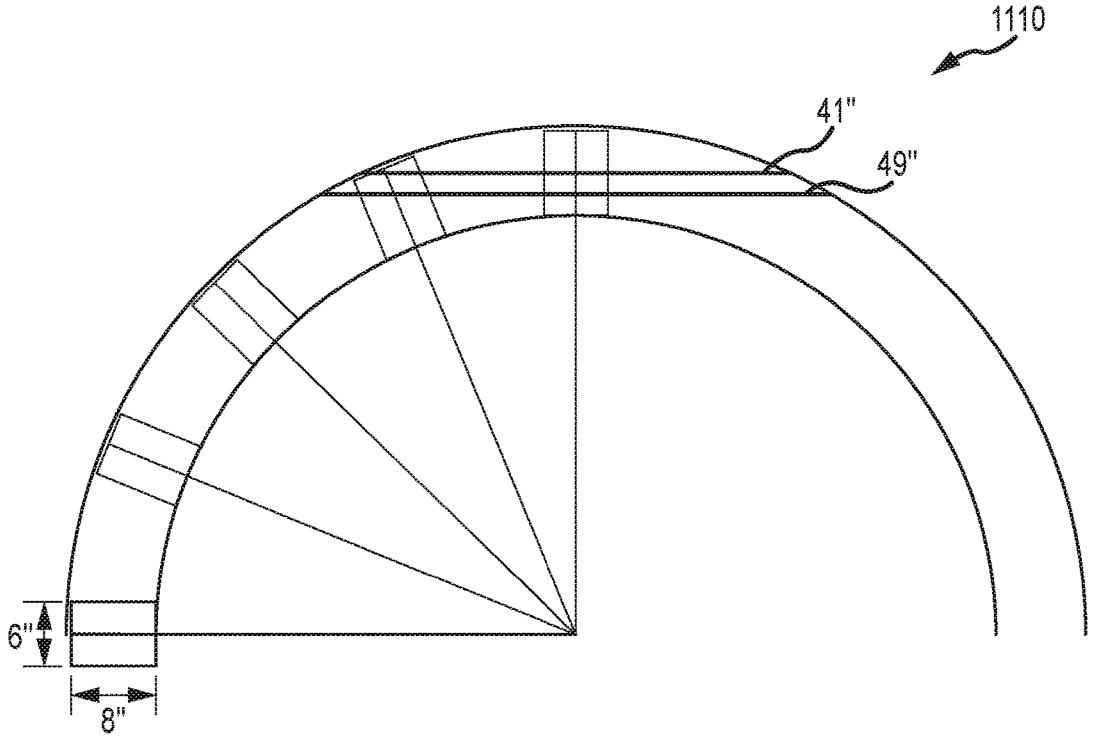

FIGS. 9-11 are graphs 910, 1010, and 1110 or graphic illustrations of various tested or modeled flag/screen sizes and/or shapes and resulting light bolts or streak lengths. The inventors performed a study to determine ways to optimize the shape of the light receiving screen or flag in order to produce the longest possible visible light streak or bolt (or laser "blast" or beam) in midair. In this study, the support rod was assumed to have a constant length of 4 feet, and, as shown in FIGS. 9-11 with graphs 910, 1010, and 1110, the radial paths for flags/screens of varying dimensions were drawn.

The first investigation of the study involved determining whether increasing the horizontal width of the flag/screen (as measured perpendicular to the support rod) would increase the size (i.e., length) of the visible volumetric light bolt/streak. The images or graphs 910 and 1010 of FIGS. 9 and 10 represent two examples of different flag widths while keeping the height of the flag/screen constant at 4 inches. Specifically, graph 910 shows results of the investigation by illustrating the flag envelope and light bolt/streak (or laser beam) length for a 4-inch by 10-inch flag. As can be seen in FIG. 9, this generates a light bolt/streak (or laser beam) with a length of 30 inches. Graph 1010 shows the effect of increasing the width form 10 inches to 14 inches. This increases the length of the light streak/bolt (or laser beam) from 30 inches up to 33 inches. As seen, the increase in flag/screen width from 10 to 14 inches produced a relatively small increase in light bolt/streak length such that the inventors determined that there is only a small benefit to increasing the width of a flag/screen.

The second investigation involved increasing the vertical height of the flag/screen (as measured parallel to the support rod). FIG. 11 shows with graph 1110 the results of increasing a flag with a width of 6 inches and a larger height of 8 inches as compared to 4 inches in the tests of FIGS. 9 and 10. This shows a resulting light streak/bolt (or laser beam) length of 41 inches, which is significantly larger than obtained with the wide but short vertical height flags used in the tests of 9 and 10. The images of FIGS. 9-11 make it clear that increasing the height of the flag/screen allows the flag/screen to cover more area in the linear path of the output light from the light source (e.g., cover or touch more of the beam/stream of collimated light, laser light, or other light from the source). Physical testing of various flag/screen shapes led to the non-intuitive discovery of an optimal flag shape of 8 inches (in height) by 6 inches (in width) based on weight, rigidity, and other factors and not to a larger flag/screen.

Additionally, the examples above indicated it may be desirable in some cases to have the linear light path bisect the rectangular screen/flag when it is fully deployed (support rod at 90 degrees). However, the inventors also made the surprising discovery that there is a noticeable change in the length of the light bolt/streak (or laser beam) displayed based on where the light path (the laser beam or the like) passes through the flag/screen.

In the image 1110 of FIG. 11, a streak/bolt with a length of 41 inches is achieved with the light path passing through the center of the flag/screen at full deployment. In contrast, a full 8 inches of length were added to the displayed light bolt/streak (or laser beam) to obtain a length of 49 inches by moving the laser slightly lower than the center of the flag/screen (such as to have the light path pass through a location that is located between 20 and 40 percent of the height of the flag when the flag/screen is fully deployed). Overall, the maximum light bolt/streak (or laser beam) length that is used or achieved for a special effects system will likely depend on each individual assembly and where the light source is located.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

The dynamic light receiving assemblies described herein may be floor mounted as shown in FIGS. 1A and 1B. However, they may also be wall or ceiling mounted and/or at an angle relative to support surface. The dynamic light receiving assemblies may also be "prop mounted" in a theatrical set with a slot provided in the surface of the prop through which the support rod and light receiving element (with the flag/screen) may pass during rotation by the driver/actuator into the display space adjacent the prop.

Many embodiments will be configured for 180-degree rotation as this facilitates hiding or disguising the presence of the driver/actuator and rod and screen when these are not being rapidly rotated. The 180-degree rotation embodiments also require relatively small amounts of space. However, other angular ranges may be used in some cases (such as 30 to 150 degrees, 45 to 135 degrees, and the like). In other cases, full rotation in a circle (360-degree rotation) is utilized with a servo actuated motor or the like being used as the driver for the support rod.

We claim:

1. A special effects apparatus for generating an illusion of a moving beam of light in midair, comprising:
- a light source generating a beam of light that is aimed along a linear light travel path; and
- a dynamic light receiving assembly, comprising:
  - an elongated support rod;
  - a light receiving element attached to a first end of the support rod; and
  - a driver coupled to a second end of the support rod opposite the first end of the support rod,
- wherein the driver rotates the support rod about the second end at a rotation rate,
- wherein, during the rotation of the support rod by the driver, the light receiving element moves along an arcuate travel path that intersects the linear light travel path of the beam of light, and
- wherein the arcuate travel path of the light receiving element and the linear light travel path are substantially coplanar.

2. The apparatus of claim 1, wherein the light receiving element comprises a planar frame and a sheet of mesh fabric supported by the planar frame and wherein the planar frame and arcuate travel path are coplanar.

3. The apparatus of claim 2, wherein the sheet of mesh fabric is rectangular in shape with a width, as measured along a side proximate to the first end of the support rod, that is less than a height of the rectangular shape.

4. The apparatus of claim 3, wherein the height is in the range of 7 to 9 inches and the width is in the range of 5 to 7 inches.

5. The apparatus of claim 3, wherein, when the support rod is fully deployed, the linear light travel path intersects the rectangular sheet of mesh fabric at a centerline or between the centerline and the side proximate to the first end of the support rod.

6. The apparatus of claim 2, wherein the mesh fabric comprises black tulle fabric.

7. The apparatus of claim 1, wherein the light source comprises a laser light source output a colored laser beam.

8. The apparatus of claim 1, wherein the light source comprises a collimated light emitting diode (LED) source and wherein the beam of light is red, green, or blue.

9. The apparatus of claim 1, wherein the rotation rate is in the range of 100 to 140 revolutions per minute (RPM).

10. The apparatus of claim 1, wherein the support rod has a length in the range of 3 to 6 feet and has a black outer surface.

11. The apparatus of claim 1, wherein the arcuate travel path is a 180 -degree arc and wherein the driver comprises a catcher assembly adapted to catch the support rod proximate to the second end and to absorb shock at opposite ends of the arcuate travel path.

12. An apparatus for displaying midair beams of light in a repeatable manner, comprising:
- a non-opaque, planar screen;
- a rod, wherein the screen is attached to a first end of the rod;
- a drive assembly coupled to a second end of the rod, wherein the drive assembly rotates the rod at a rotation rate greater than 100 RPM to move the screen along an arcuate path; and
- a light source outputting a beam of light targeted along a linear path,
- wherein the arcuate path is in a plane containing the linear path,
- wherein the screen passes through linear path during travel along the arcuate path whereby the beam of light strikes a portion of the screen,
- wherein the rotation rate is greater than 120 RPM,
- wherein the arcuate path is a 180 -degree arc, and
- wherein the drive assembly comprises first and second catchers for receiving the rod at each end of the 180 -degree arc to slow deceleration or absorb shock.

13. The apparatus of claim 12, wherein the screen comprises a black mesh fabric or a black tulle fabric.

14. The apparatus of claim 12, wherein the portion of the screen struck by the light over a plurality of positions of the rod has a length of at least 30 inches.

15. The apparatus of claim 12, wherein the screen is struck by the light over a range of angular positions of the rod, wherein the screen is rectangular, and wherein the portion of the screen struck by the light is at or below the centerline of the screen when the rod is at a 90 -degree angular position.

16. The apparatus of claim 12, wherein the beam of light is collimated, colored light from a laser light source or a collimated LED source.

17. An apparatus for displaying a stream or bolt of light in midair, comprising:

a light source generating a beam of light along a linear travel path; and two or more light receiving assemblies, wherein each of the light receiving assemblies, comprises:

a support rod;

a planar, non-opaque screen attached to a first end of the support rod; and a driver coupled to a second end of the support rod opposite the first end of the support rod, wherein the driver rotates the support rod about the second end at a rotation rate, wherein, during the rotation of the support rod by the driver, the screen moves along an arcuate travel path passes through the linear light travel path of the beam of light at a plurality of angular positions of the support rod, and wherein the arcuate travel path of the screen and the linear travel path of the beam of light are substantially coplanar.

18. The apparatus of claim 17, wherein the screen comprises black tulle fabric.

19. The apparatus of claim 17, wherein the screen is rectangular with a width, as measured along a side proximate to the first end of the support rod, that is less than a height of the rectangular shape, wherein the height is in the range of 7 to 9 inches and the width is in the range of 5 to 7 inches, wherein, when the support rod is fully deployed, the linear light travel path intersects the screen at a centerline or between the centerline and the side proximate to the first end of the support rod, and wherein the rotation rate is greater than about 120RPM.

20. The apparatus of claim 17, wherein the arcuate travel path is a 180 -degree arc and wherein the driver comprises a catcher assembly adapted to catch the support rod proximate to the second end and to absorb shock at opposite ends of the arcuate travel path.

21. An apparatus for displaying midair beams of light in a repeatable manner, comprising:

a non-opaque, planar screen;

a rod, wherein the screen is attached to a first end of the rod;

a drive assembly coupled to a second end of the rod, wherein the drive assembly rotates the rod at a rotation rate greater than 100 RPM to move the screen along an arcuate path; and a light source outputting a beam of light targeted along a linear path, wherein the arcuate path is in a plane containing the linear path, wherein the screen passes through linear path during travel along the arcuate path whereby the beam of light strikes a portion of the screen, wherein the screen is struck by the light over a range of angular positions of the rod, wherein the screen is rectangular, and wherein the portion of the screen struck by the light is at or below the centerline of the screen when the rod is at a 90-degree angular position.

22. The apparatus of claim 21, wherein the screen comprises a black mesh fabric or a black tulle fabric.

23. The apparatus of claim 21, wherein the portion of the screen struck by the light over a plurality of positions of the rod has a length of at least 30 inches.

24. The apparatus of claim 21, wherein the beam of light is collimated, colored light from a laser light source or a collimated LED source.

* * * * *